US005617609A

United States Patent [19]

Bently

[11] Patent Number: 5,617,609

[45] Date of Patent: Apr. 8, 1997

[54] AIR NOZZLE/FLEXIBLE WHIP CLEANING MEANS FOR DUCTWORK

[76] Inventor: John F. Bently, 11153 S. Wilton River Rd., New Richland, Minn. 56072

[21] Appl. No.: 492,532

[22] Filed: Jun. 20, 1995

[51] Int. Cl.[6] ..... B08B 5/02

[52] U.S. Cl. ..... 15/318; 15/406; 239/229

[58] Field of Search ..... 134/166 C, 168 C, 134/169 C, 167 C; 15/405, 406, 407, 408, 395, 382, 318; 239/229

[56] References Cited

U.S. PATENT DOCUMENTS

| | | | |
|---|---|---|---|
| 1,465,711 | 8/1923 | Gray . | |
| 1,587,194 | 6/1926 | Sladden . | |
| 2,156,370 | 5/1939 | Brownfield | 141/1 |
| 2,735,122 | 2/1956 | Pletcher | 15/104.3 |
| 2,735,794 | 2/1956 | Pletcher | 134/24 |
| 3,215,560 | 11/1965 | Kredit | 15/406 |
| 3,485,671 | 12/1969 | Stephens | 134/7 |
| 3,820,172 | 6/1974 | Kane | 134/167 R |
| 3,897,605 | 8/1975 | Dickinson | 239/229 |
| 3,946,459 | 3/1976 | Armstrong | 15/377 |
| 4,141,753 | 2/1979 | Creed | 134/8 |
| 4,178,949 | 12/1979 | Mazon, III | 134/167 R |
| 4,186,759 | 2/1980 | Stevenson et al. | 134/166 R |
| 4,332,292 | 6/1982 | Garberick | 239/229 |
| 4,508,577 | 4/1985 | Lindenmuth et al. | 134/1 |
| 4,718,142 | 1/1988 | Wahlers | 15/406 |
| 4,792,363 | 12/1988 | Franklin, Jr. et al. | 134/8 |
| 4,881,856 | 11/1989 | Greig | 239/229 |
| 4,915,312 | 4/1990 | Hiemstra | 239/229 |
| 5,003,998 | 4/1991 | Collett | 134/22.12 |
| 5,072,487 | 12/1991 | Walton | 15/406 |
| 5,107,568 | 4/1992 | Wade | 15/395 |
| 5,109,567 | 5/1992 | Harrison | 15/406 |
| 5,127,578 | 7/1992 | Choi et al. | 239/229 |
| 5,228,484 | 7/1993 | Johnson | 134/166 C |
| 5,296,038 | 3/1994 | Faxon | 134/22.11 |
| 5,347,677 | 9/1994 | Prentice | 15/406 |
| 5,383,973 | 1/1995 | Curry, Jr. | 134/8 |
| 5,383,975 | 1/1995 | Faxon | 15/405 |

FOREIGN PATENT DOCUMENTS

| | | | |
|---|---|---|---|
| 885626 | 12/1961 | United Kingdom | 134/167 C |

*Primary Examiner*—Frankie L. Stinson

[57] ABSTRACT

There is mentioned an air nozzle/flexible whip cleaning means for ductwork which is connected to a source of high pressure air using at least a plurality of connectable lengths of semi rigid plastic pipe 8. The means comprises at least one primary air nozzle 1 to which a flexible tubing whip 4 may be attached. At least one round headed reverse air nozzle 11 and at least one round headed forward air nozzle 12 may be included, the purpose of the nozzle heads and flexible tubing whip being to direct air in different directions as helpful for the purpose of removing dust, debris and unwanted foreign matter from the interior of ductwork.

3 Claims, 4 Drawing Sheets

AIR NOZZLE/FLEXIBLE WHIP CLEANING MEANS FOR DUCTWORK

BACKGROUND-FIELD OF INVENTION

The present invention is a means for cleaning ductwork associated with heating, ventilating and air conditioning systems.

BACKGROUND OF THE INVENTION

The need for cleaning heating, ventilation and air conditioning (HVAC) ductwork is well documented. Undesirable foreign elements such as dust, dirt, construction materials and other debris accumulate in ductwork during normal operation of HVAC systems. Larger debris often enters ductwork systems as a result of construction, remodeling or through vent openings. Since ductwork systems are often enclosed within walls, ceilings and other interior structures of buildings, it is desirable to be able to clean ductwork without disassembling it, and without drilling many access holes into it.

BACKGROUND DESCRIPTION OF PRIOR ART

Means previously developed and currently being used for the cleaning of HVAC duct systems usually propel themselves forward through the ductwork with the force of compressed air through a flexible hose connected to a self propelling hose nozzle. These means cannot be efficiently guided through ductwork, since the force of their propulsion makes their movement inherently random and because the means tend to migrate to the side of the ductwork, failing to remove substances which have collected on the tops and high corners of the ductwork. The range of these means also tends to be limited, since continually increasing force is required to propel the longer and longer hose length which is fed into the ductwork.

A cleaning method of this type is disclosed in U.S. Pat. No. 3,215,560 issued to Kredit and in U.S. Pat. No. 5,003,998 issued to Collett. These cleaning methods utilize a self propelling hose nozzle which exhibits the disadvantages mentioned above. These methods also require that access holes be drilled every 7 to 15 feet, which is not always possible when working with ductwork enclosed in ceilings and walls. U.S. Pat. Nos. 5,383,975 and 5,296,038, issued to Faxon disclose a cleaning method with many of these same disadvantages. The method disclosed in these patents also requires an exceptionally large air compressor, which not all air duct cleaners have available. The method also is impractical for multi-story buildings because of the size of air compressor needed. The effective range of these methods is usually 20 to 75 feet. Therefore there is a need for an air duct cleaning method which overcomes these disadvantages and has an extended effective range suitable for long lengths of enclosed ductwork. Currently many types of duct cleaning equipment require large access holes to insert the equipment into ductwork.

Nozzles as disclosed in prior art patents are connected to supply conduits using clamping devices which prevent them from being readily interchanged or replaced.

SUMMARY OF THE INVENTION

The principle object of the present invention is to provide a means for removing unwanted foreign materials from the interior of ductwork, including, but not limited to heating, ventilating and air conditioning (HVAC) ducts. It also is an object of the present invention to make it possible to clean all interior surfaces of ductwork, including sides, tops and high corners while requiring a limited number of access holes, each of limited size. Another object of the invention is to provide flexible options for cleaning ductwork of different and varying configurations by using easily interchangeable nozzles and locking quick disconnect fittings. A further object is to provide a cleaning means which is effective in extended lengths of ductwork, possibly in excess of 150 feet and ductwork which is enclosed and therefore provides limited opportunity for access. It is also an aim of the present invention to provide a means of cleaning ductwork which can be more easily guided and steered through ductwork. The present invention also aims to be compatible with many different types of air compressors and with duct cleaning equipment currently being used by commercial HVAC duct cleaners.

The foregoing objectives are achieved with a cleaning means which is connected to a compressed air source using connected lengths of semi rigid plastic pipe which serve as a supply conduit. This cleaning means is comprised of a variety of interchangeable nozzles which connect to said supply conduit with a locking quick disconnect fitting. Said nozzles have an axial bore with a plurality of orifices which connect radially with said bore. Said orifices direct compressed air outward at an acute angle to said bore in the direction of cleaning. In certain nozzles, said bore also allows air to pass through another connecting unit such as a hose barb to a length of flexible tubing. Said flexible tubing whips itself about when compressed air is introduced. Both this whipping motion and the compressed air propelled through said tubing work together with the air propelled outward through said radially connected orifices to help dislodge unwanted foreign material from the interior sides, corners, floors, top and interior supports of the ductwork.

DETAILED DESCRIPTION OF PREFERRED EMBODIMENTS

Figure 1:
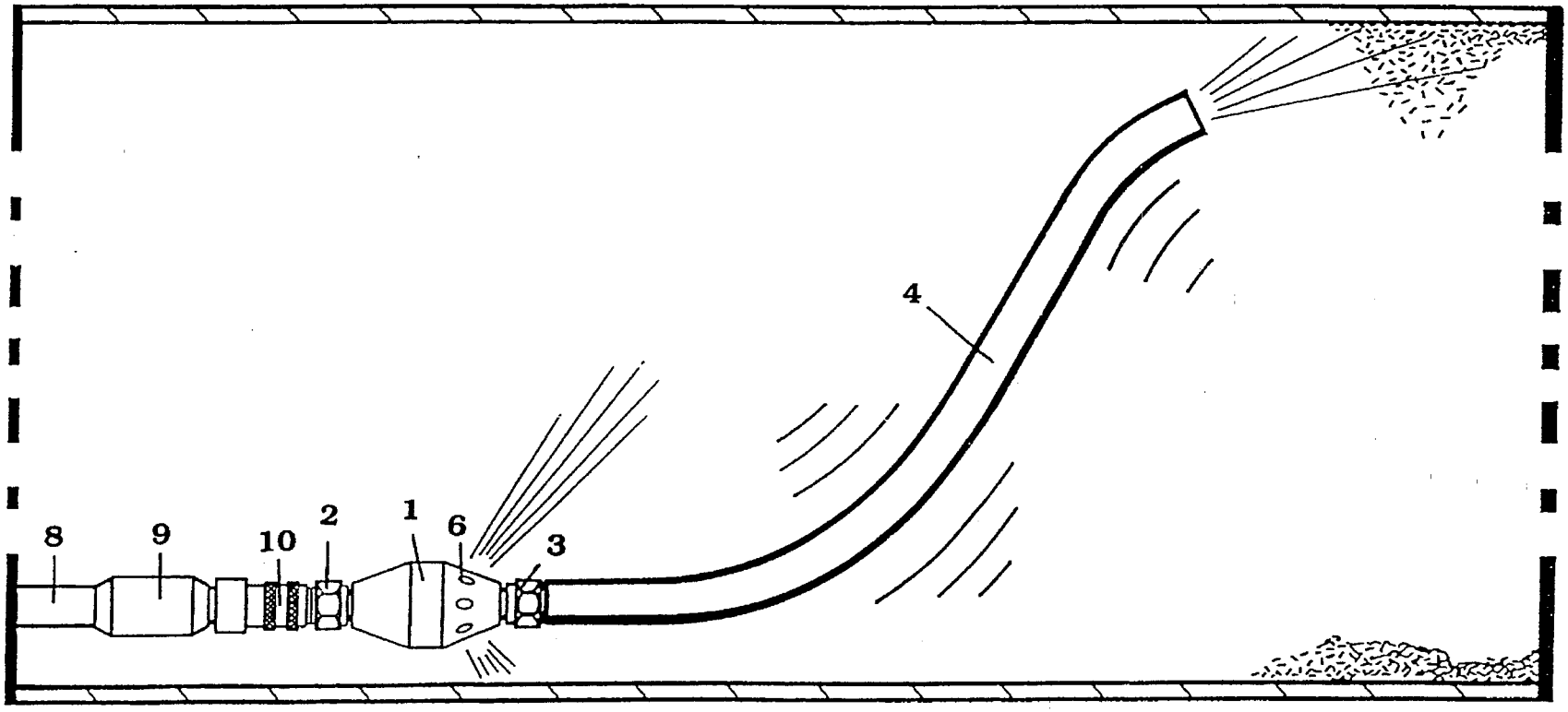
FIG. 1 shows an embodiment with the present invention in a cleaning arrangement in operation in a rectangularly shaped duct illustration, where the cleaning means is moving forward and air movement and the sweeping movement of a flexible tubing whip are working unwanted foreign materials forward.

In FIG. 1 the cleaning means is shown inserted in a rectangularly shaped duct where unwanted foreign material is to be cleaned from interior surfaces of the duct. In the scope of this document, cleaning refers to the removal of unwanted foreign materials from interior surfaces of the duct using the movement and force of high pressure air. In this illustration the cleaning means is configured for forward cleaning. A flexible tubing whip 4 is sweeping through ductwork dislodging unwanted foreign material. Said whip is attached using a hose barb 3 to a primary nozzle body 1 which is turned facing forward. Said primary nozzle body 1 is connected using a locking male quick disconnect fitting 2 to a supply conduit 8 using a solvent welded coupling 9 and a locking female quick disconnect fitting 10.

Figure 2:
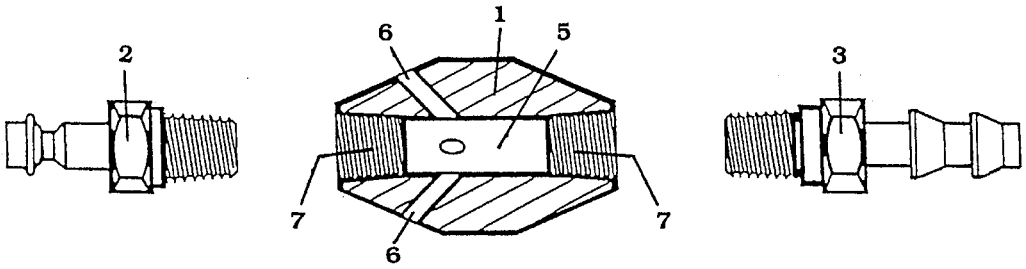
FIG. 2 shows a primary nozzle body in a sectional view and connectors.

FIG. 2 shows an embodiment of a locking male quick disconnect fitting 2 and hose barb 3 as disengaged from a primary nozzle body 1. Said primary nozzle body 1 is shown in cross sectional view, illustrating an axial bore 5 with threaded sections of axial bore 7 and orifices connected radially to said axial bore 6.

Figure 3:
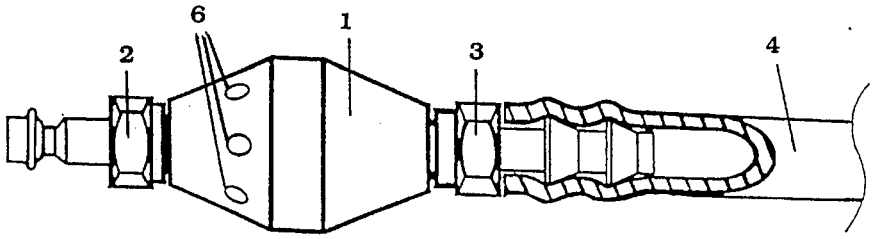
FIG. 3 shows an embodiment with a primary nozzle body with connectors and sectional view of attached flexible tubing whip.

The embodiment shown in FIG. 3 is a cutaway side view of a flexible tubing whip 4 as attached to a primary nozzle body 1 using a hose barb 3. A locking male quick disconnect fitting 2 is also shown attached to said primary nozzle body 1 which is in configuration for reverse cleaning.

Figure 4:
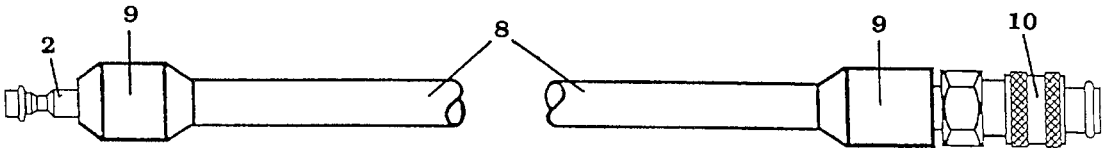
FIG. 4 shows an embodiment of a length of connectable supply conduit with locking male and female quick disconnect fittings.

FIG. 4 shows an embodiment of a connectable supply conduit, which consists of a length of semi rigid plastic pipe 8 with solvent-welded plastic couplings 9 on both ends. A locking female quick disconnect fitting 10 and a locking male quick disconnect fitting 2 are threaded into opposing ends of said semi rigid plastic pipe 8 using solvent-welded plastic couplings 9.

Figure 5:
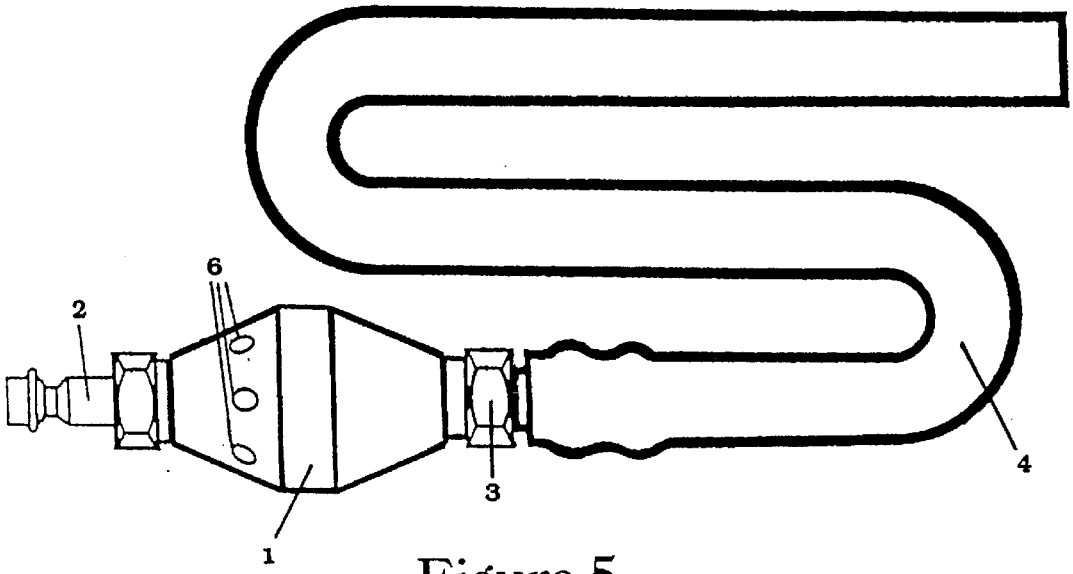
FIG. 5 shows an embodiment of a primary nozzle body with locking male quick disconnect fitting, hose barb connector and flexible tubing whip as configured for cleaning in a reverse direction.

The embodiment shown in FIG. 5 is a primary nozzle body in configuration with a locking male quick disconnect fitting 2, a hose barb 3, and a flexible tubing whip 4. This view shows the cleaning means configured for cleaning in a reverse direction.

Figure 6:
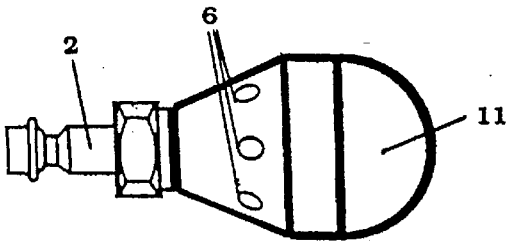
FIG. 6 shows an embodiment of a round-headed reverse air nozzle body with a locking male quick disconnect fitting and a rounded head for use while cleaning in a reverse direction without flexible tubing whip.

FIG. 6 shows an embodiment of a round-headed reverse air nozzle body 11 with a locking male quick disconnect fitting 2. Said round-headed reverse air nozzle body is designed for use without a flexible tubing whip in applications where cleaning in a reverse direction is desired.

Figure 7:
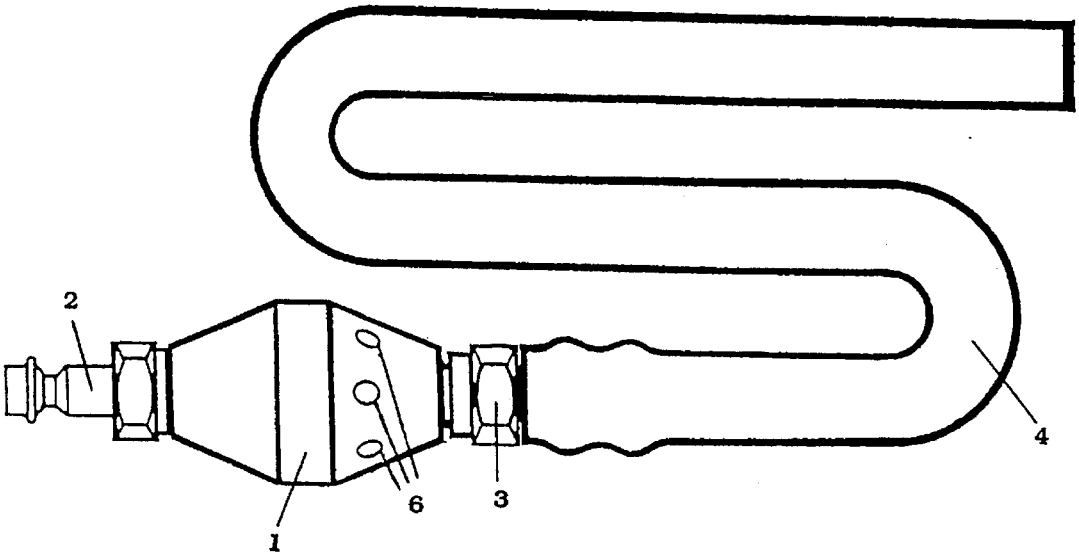
FIG. 7 shows an embodiment of a primary nozzle body with locking male quick disconnect fitting, hose barb connector and flexible tubing whip as configured for cleaning in a forward direction.

The embodiment shown in FIG. 7 is a primary nozzle body 1 in configuration with a locking male quick disconnect fitting 2, a hose barb 3, and a flexible tubing whip 4. This view shows the cleaning means configured for cleaning in a forward direction.

Figure 8:
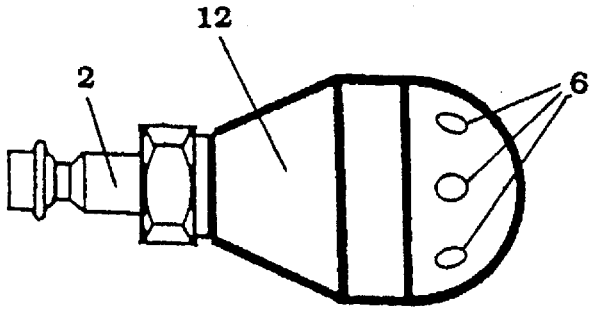
FIG. 8 shows an embodiment of a round-headed forward air nozzle body with a locking male quick disconnect fitting and a rounded head for use while cleaning in a forward direction without flexible tubing whip.

FIG. 8 shows an embodiment of a round-headed forward air nozzle body 12 with a locking male quick disconnect fitting 2. Said round-headed forward air nozzle body is designed for use without a flexible tubing whip in applications where cleaning in a forward direction is desired.

Figure 9:
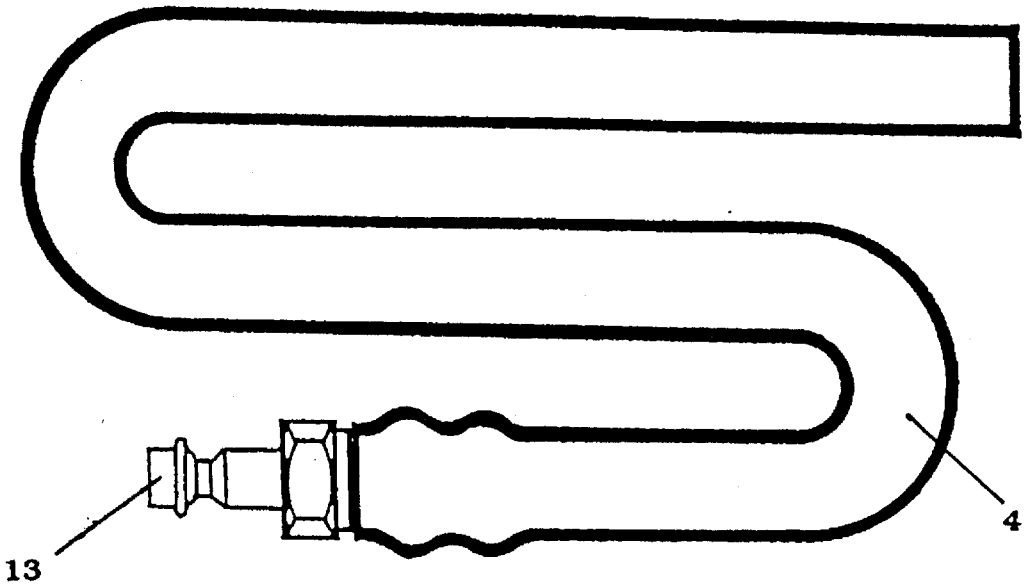
FIG. 9 shows an embodiment of a locking male quick disconnect fitting with flexible tubing whip.

The view in FIG. 9 shows an embodiment of a flexible tubing whip 4 connected to a locking male quick disconnect hose barb 13. This configuration can be used without any nozzle body for use in selected duct cleaning applications.

The components illustrated and described above together comprise a means for cleaning ductwork. The variety of interchangeable nozzle bodies provides flexibility by allowing a duct cleaner to choose between the nozzle bodies for different selected applications. The cleaning of a single ductwork system may require as few as a single nozzle body or may require that a duct cleaner use any number of nozzle bodies one at a time throughout the course of the cleaning, each one being chosen for its advantages in different types of ducts and in removing different kinds of debris and unwanted material. As shown in FIG. 9, a flexible whip 4 may also be used without any nozzle body, but instead be attached using a locking male quick disconnect hose barb 13 to a connectable length of semi rigid plastic pipe for use in chosen applications.

Use of semi rigid plastic pipe also provides a duct cleaner with the ability to steer and guide the cleaning means with some precision toward a chosen side of ductwork or a chosen location within ductwork.

My invention has been thoroughly tested and found to be completely satisfactory for the accomplishment of the above objects.

Having illustrated and described the principles of my invention in a preferred embodiment and variations thereof, it should be apparent to those skilled in the art that the invention may be modified in arrangement and detail without departing from the principles thereof. I claim as my invention all modifications coming within the scope and spirit of the following claims.

I claim:

1. A means for the removal of unwanted foreign matter from the interior of ductwork, including, but not limited to heating, ventilating and air conditioning ductwork associated with Heating, Ventilating and Air Conditioning (HVAC) systems; said means employing the combined effects of the physical motion of a whip and of rapidly moving air from orifices in said means to loosen and remove unwanted matter; said means comprising:

a supply conduit made up of but not limited to a plurality of connectable lengths of semi rigid pipe, each with locking female and male quick disconnect fittings at opposing ends of said semi rigid pipe; and at least one primary nozzle body, composed of a single tooled piece of material such as metal or plastic; said nozzle body being attachable to above said supply conduit via a locking quick disconnect fitting, said primary nozzle body having an axial bore with at least one orifice which connects radially at an acute angle with said bore; said primary nozzle body can be turned to direct pressurized fluid either in a forward or reverse direction while cleaning; said axial bore in said primary nozzle body also allows air to pass through a connecting unit such as a hose barb to a single length of flexible tubing; said flexible tubing composed of a durable material such as rubber or plastic; said flexible tubing whips itself about when pressurized fluid is introduced, thus loosening compacted or affixed material from the ductwork and allowing the force of pressurized fluid issued from the above said nozzle body orifice to push above said unwanted material in a desirable direction.

2. The means of claim 1 comprising:

at least one round-headed forward nozzle body composed of a single tooled piece of material such as metal or plastic; said nozzle body being attachable to above said supply conduit via a locking quick disconnect fitting, said round-headed nozzle body having an axial bore with at least one orifice which connects radially at an acute angle with said bore; said orifice directs compressed air in a forward direction at an acute angle to said axial bore while cleaning.

3. The means of claim 2 comprising:

at least one round-headed reverse nozzle body composed of a single tooled piece of material such as metal or plastic; said nozzle body being attachable to above said supply conduit via a locking quick disconnect fitting, said round-headed nozzle body having an axial bore with at least one orifice which connects radially at an acute angle with said bore; said orifice directs compressed air in a reverse direction at an acute angle to said axial bore while cleaning.

* * * * *